US010138797B2

(12) United States Patent
Kubo et al.

(10) Patent No.: US 10,138,797 B2
(45) Date of Patent: Nov. 27, 2018

(54) INTERNAL COMBUSTION ENGINE

(71) Applicant: NISSAN MOTOR CO., LTD., Yokohama-shi, Kanagawa (JP)

(72) Inventors: Yu Kubo, Kanagawa (JP); Takao Ito, Kanagawa (JP)

(73) Assignee: NISSAN MOTOR CO., LTD., Yokohama-shi (JP)

( * ) Notice: Subject to any disclaimer, the term of this patent is extended or adjusted under 35 U.S.C. 154(b) by 0 days.

(21) Appl. No.: 15/320,876

(22) PCT Filed: Jun. 30, 2014

(86) PCT No.: PCT/JP2014/067428
§ 371 (c)(1),
(2) Date: Dec. 21, 2016

(87) PCT Pub. No.: WO2016/001987
PCT Pub. Date: Jan. 7, 2016

(65) Prior Publication Data

US 2017/0159541 A1 Jun. 8, 2017

(51) Int. Cl.
*F02F 1/14* (2006.01)
*F01P 3/02* (2006.01)
(Continued)

(52) U.S. Cl.
CPC ..... *F01P 3/02* (2013.01); *F01P 7/14* (2013.01); *F02D 35/00* (2013.01); *F02F 1/002* (2013.01);
(Continued)

(58) Field of Classification Search
CPC ... F01P 3/02; F01P 7/14; F02B 77/085; F02D 35/00; F02F 1/002; F02F 1/10; F02F 1/14; F02F 1/242; F02F 1/36
(Continued)

(56) References Cited

U.S. PATENT DOCUMENTS 2,107,389 A * 2/1938 Price ..... F01L 1/28 123/190.8
2,700,964 A * 2/1955 Nallinger ..... F02F 1/002 123/193.3
(Continued)

FOREIGN PATENT DOCUMENTS

FR 2208454 A5 6/1974
GB 1 446 847 A 8/1976
(Continued)

OTHER PUBLICATIONS

USPTO Office Action, U.S. Appl. No. 15/320,431, dated Feb. 27, 2018, 15 pages.
(Continued)

*Primary Examiner* — Marguerite McMahon
*Assistant Examiner* — Tea Holbrook
(74) *Attorney, Agent, or Firm* — Foley & Lardner LLP

(57) ABSTRACT

An internal combustion engine includes: a cylinder block in which a cylinder is formed; a cylinder head including an intake port and an exhaust port, the cylinder head being integrally formed with the cylinder block; a water jacket covering circumferences of the cylinder, the intake port, and the exhaust port; a partition wall dividing the water jacket into a cylinder block side and a cylinder head side; and a knock sensor mounting boss provided on a side surface of the internal combustion engine, at a position on an extension line of the partition wall.

7 Claims, 4 Drawing Sheets

(51) Int. Cl.

| | |
|---|---|
| ***F02F 1/10*** | (2006.01) |
| ***F02F 1/36*** | (2006.01) |
| ***F02D 35/00*** | (2006.01) |
| ***F01P 7/14*** | (2006.01) |
| ***F02F 1/00*** | (2006.01) |
| *F02B 77/08* | (2006.01) |
| *F02F 1/24* | (2006.01) |

(52) U.S. Cl.
CPC ..... *F02F 1/10* (2013.01); *F02F 1/14* (2013.01); *F02F 1/36* (2013.01); *F02B 77/085* (2013.01); *F02F 1/242* (2013.01)

(58) Field of Classification Search
USPC .... 123/195 R, 195 H, 196 S, 406.11, 406.12
See application file for complete search history.

(56) References Cited

U.S. PATENT DOCUMENTS

| | | | | | |
|---|---|---|---|---|---|
| 2,700,969 | A * | 2/1955 | Nallinger | F02F 1/4285 | 123/193.5 |
| 2,710,602 | A * | 6/1955 | Maybach | F01L 1/265 | 123/41.76 |
| 2,800,118 | A * | 7/1957 | Scherenberg | F02M 69/00 | 123/298 |
| 2,941,521 | A * | 6/1960 | Shrimpton | F02F 1/38 | 123/184.33 |
| 3,457,904 | A * | 7/1969 | Roberts | F02M 1/00 | 123/184.34 |
| 3,646,919 | A | 3/1972 | Reisacher | | |
| 3,691,914 | A * | 9/1972 | Reisacher | F02F 1/002 | 123/193.3 |
| 3,983,852 | A * | 10/1976 | Chatourel | F01L 1/0532 | 123/195 C |
| 4,092,956 | A * | 6/1978 | List | F02F 1/002 | 123/193.3 |
| 4,213,440 | A * | 7/1980 | Abe | F02B 77/13 | 123/195 C |
| 4,468,950 | A * | 9/1984 | Ishigami | F02B 77/085 | 73/35.09 |
| 4,660,527 | A * | 4/1987 | Tanaka | F01L 1/0532 | 123/193.5 |
| 4,805,563 | A * | 2/1989 | Nishimura | F02F 1/002 | 123/41.74 |
| 4,873,944 | A * | 10/1989 | Yamada | F01P 9/04 | 123/41.57 |
| 4,969,441 | A * | 11/1990 | Komurasaki | F02B 75/22 | 123/406.4 |
| 5,829,402 | A * | 11/1998 | Takahashi | F02B 61/045 | 123/184.24 |
| 5,924,404 | A * | 7/1999 | Ruman | F02B 61/045 | 123/406.18 |
| 9,442,034 | B2 * | 9/2016 | Moetakef | G01L 23/221 | |
| 2001/0039908 | A1 * | 11/2001 | Bilek | F01B 1/12 | 114/55.5 |
| 2010/0236578 | A1 * | 9/2010 | Noda | B08B 3/02 | 134/23 |
| 2011/0315098 | A1 * | 12/2011 | Kosugi | B22C 9/103 | 123/41.74 |
| 2013/0167784 | A1 * | 7/2013 | Quix | F02M 25/0738 | 123/41.1 |
| 2013/0247848 | A1 | 9/2013 | Takahashi | | |
| 2015/0377081 | A1 * | 12/2015 | Jones | F01L 1/18 | 123/90.44 |
| 2016/0273478 | A1 * | 9/2016 | Mandorfer | B22C 9/10 | |

FOREIGN PATENT DOCUMENTS

| | | | | |
|---|---|---|---|---|
| JP | 58-136731 | U | 9/1983 | |
| JP | 59008517 | A * | 1/1984 | B60H 1/025 |
| JP | 61-062227 | U | 4/1986 | |
| JP | 61-152723 | U | 9/1986 | |
| JP | 02-090319 | U | 7/1990 | |
| JP | 05-187307 | A | 7/1993 | |
| JP | 2001-193520 | A | 7/2001 | |
| WO | WO-2012/081081 | A1 | 6/2012 | |

OTHER PUBLICATIONS

U.S. Appl. No. 15/320,431, filed Dec. 20, 2016, Nissan Motor Co., Ltd.

USPTO Office Action, U.S. Appl. No. 15/320,431, dated Aug. 13, 2018, 11 pages.

* cited by examiner

INTERNAL COMBUSTION ENGINE

TECHNICAL FIELD

This invention relates to an internal combustion engine in which a cylinder head and a cylinder block are integrally casted.

BACKGROUND ART

In many internal combustion engines which are actually used for vehicles, a cylinder block and a cylinder head are separately (independently) casted, the cylinder block and the cylinder head are tightened by a plurality of cylinder head bolts.

Contrary to this, a patent document 1 discloses an internal combustion engine in which a cylinder head and a cylinder block are integrally casted. In the patent document 1, a water jacket is divided by a partition wall into a head side water jacket around a combustion chamber, and a cylinder side water jacket around the cylinder, so as to adequately adjust temperature distributions of the cylinder head side and the cylinder block side.

The head side water jacket is arranged to forcibly circulate the coolant from one end side of a cylinder row direction toward the other end side. Moreover, the cylinder side water jacket is connected to the head side water jacket through a through hole formed in the partition wall, and to circulate the coolant between the head side water jacket and the cylinder side water jacket by natural convection.

However, in the cylinder block disclosed in the patent document 1 in which there is provided the partition wall dividing the water jacket into the cylinder head side and the cylinder block side, a position of a knock sensor is not sufficiently considered. There is a room for improving the position of the knock sensor.

PRIOR ART DOCUMENT

Patent Document

Patent Document 1: Japanese Patent Application Publication No. 5-187307

SUMMARY OF THE INVENTION

An internal combustion engine according to the present invention comprises: a cylinder block in which a cylinder is formed; a cylinder head including an intake port and an exhaust port, the cylinder head being integrally formed with the cylinder block; a water jacket covering circumferences of the cylinder, the intake port, and the exhaust port; a partition wall dividing the water jacket into a cylinder block side and a cylinder head side; and a knock sensor mounting boss provided on a side surface of the internal combustion engine, at a position on an extension line of the partition wall.

In the present invention, the vibration of the knocking generated within the combustion chamber is easy to be transmitted to the partition wall. Accordingly, it is possible to improve the detection accuracy of the knocking by the knocking sensor mounted to the knocking sensor mounting boss positioned on an extension of the partition wall, to further stabilize the combustion within the combustion chamber, and to further suppress the abnormal pressure variation within the combustion chamber.

DESCRIPTION OF EMBODIMENTS

Figure 1:
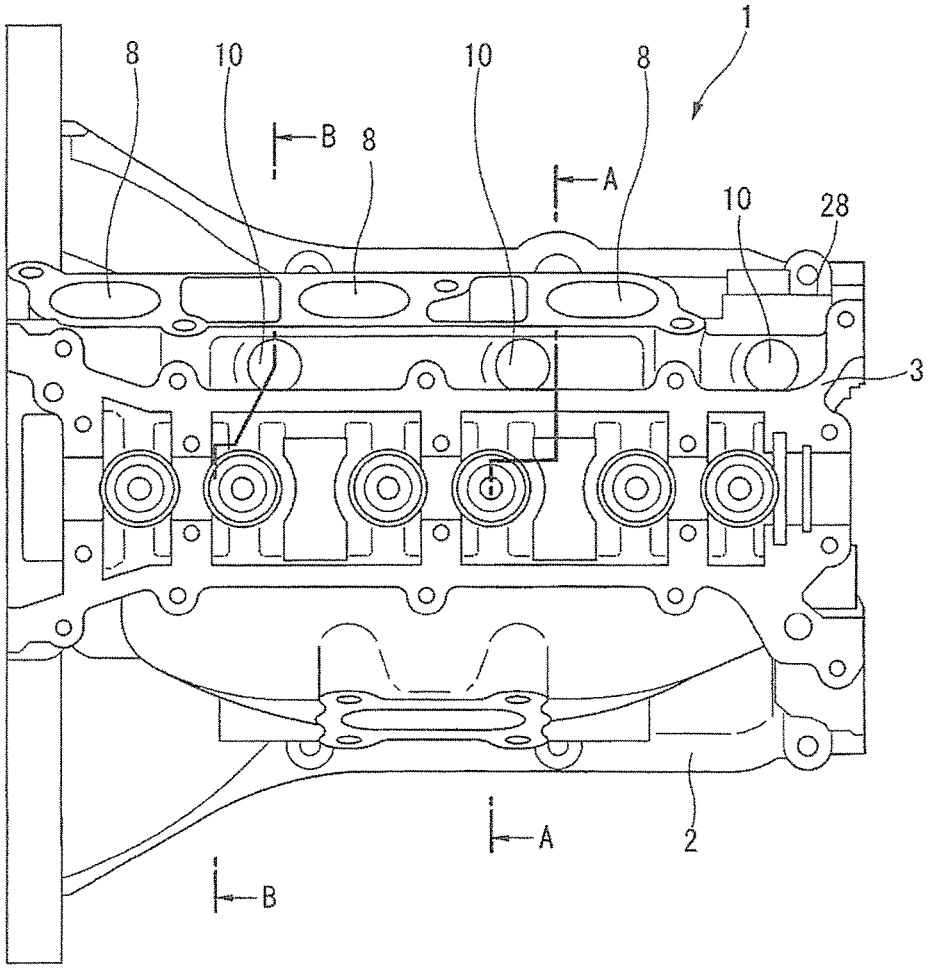
FIG. 1 is a plan view showing an internal combustion engine according to the present invention.
Figure 2:
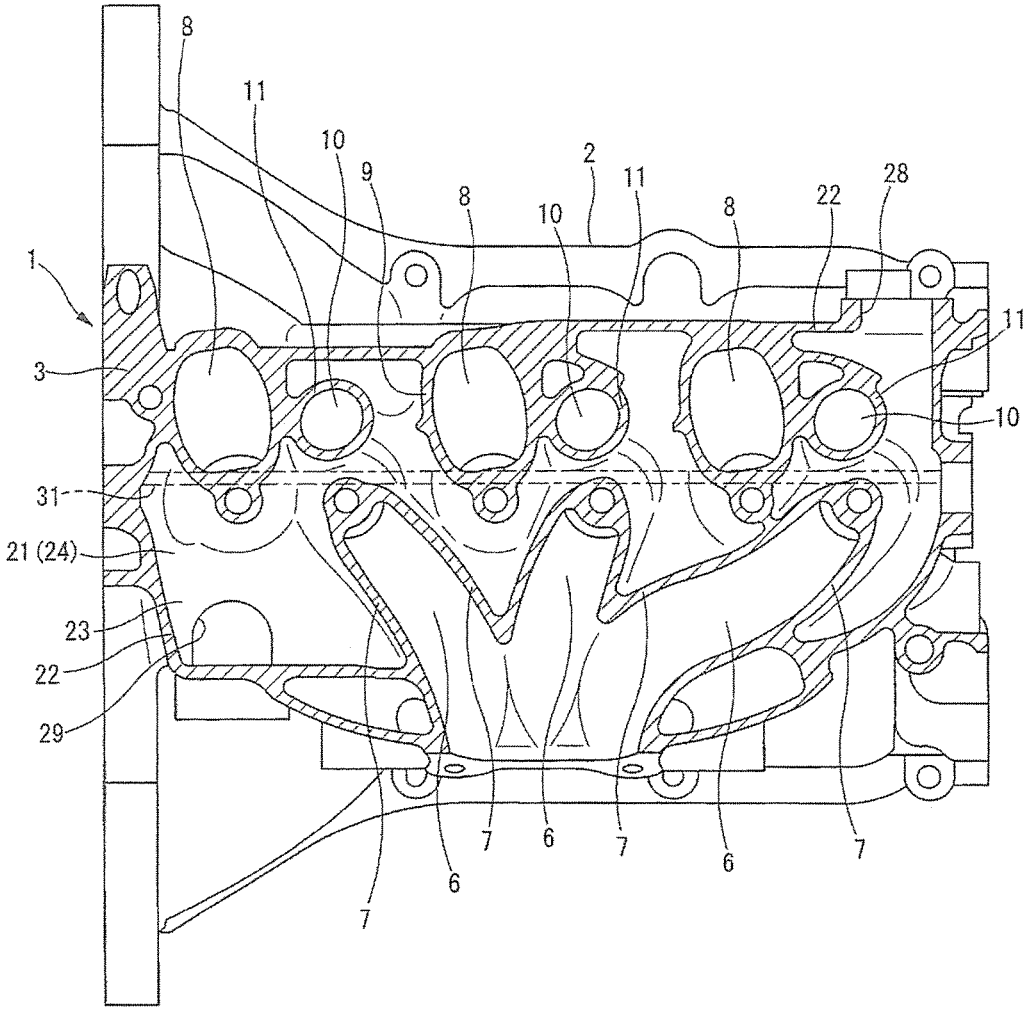
FIG. 2 is a sectional view showing main parts according to the present invention.
Figure 3:
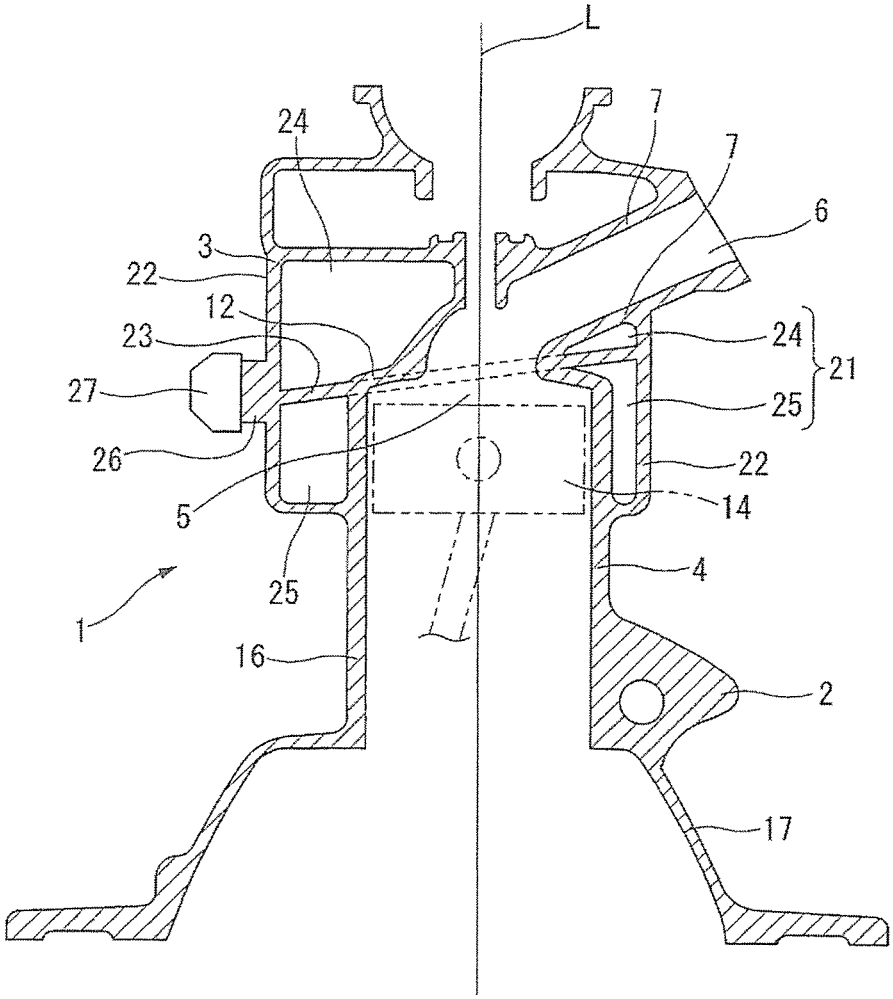
FIG. 3 is a sectional view taken along a section line A-A of FIG. 1.
Figure 4:
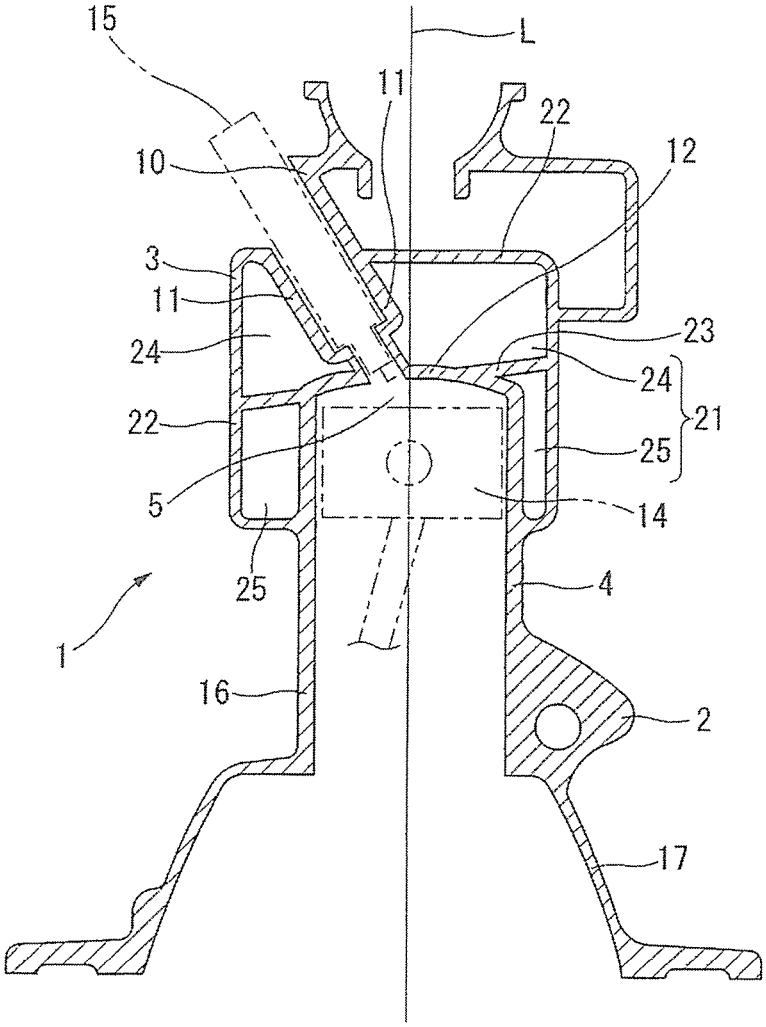
FIG. 4 is a sectional view taken along a section line B-B of FIG. 1.

Hereinafter, an in-line three-cylinder internal combustion engine of SOHC type according to one embodiment of the present invention is explained in detail based on the drawings FIG. 1 to FIG. 4 show explanation views showing an internal combustion engine 1 to which the present invention is applied. FIG. 1 is a plan view. FIG. 2 is a sectional view showing main parts. FIG. 3 is a sectional view taken along a section line A-A of FIG. 1. FIG. 4 is a sectional view taken along a section line B-B of FIG. 1.

The internal combustion engine 1 according to embodiment is made from metal material such as aluminum alloy. Portions of the internal combustion engine 1 are integrally casted. The internal combustion engine 1 includes a cylinder block 2 in which three cylinders 4 are disposed in series with one another, and a cylinder head 3 covering upper ends of the cylinders 4 so as to form a combustion chamber 5. The cylinder block 2 and the cylinder head 3 are integrally formed with each other. The combustion chamber 5 is defined by the cylinder 4, a piston 14 arranged to be reciprocated within the cylinder 4, and the cylinder head 3.

The cylinder head 3 includes an exhaust port wall 7 forming an exhaust port 6; an intake port wall 9 forming an intake port 8; and an ignition plug mounting wall 11 forming an ignition plug mounting portion 10.

The exhaust port 6 is connected from a one side surface side of the internal combustion engine 1 (on lower sides of FIG. 1 and FIG. 2, or right sides of FIG. 3 and FIG. 4 which are one side surface side of the cylinder head 3), to a top wall 12 which is a top portion (ceiling surface) of the combustion chamber 5. The intake port 8 is connected from the other side surface side of the internal combustion engine 1 (on upper sides of FIG. 1 and FIG. 2, or right sides of FIG. 3 and FIG. 4 which are the other side surface side of the cylinder head 3), to the top wall 12 of the combustion chamber 5. The ignition plug mounting portion 10 is connected from the upper side to the top wall 12 of the combustion chamber 5.

A tip end side of one exhaust port 6, a tip end side of one intake port 8, and a tip end side of one ignition plug mounting portion 10 are connected to the top wall 12 of each cylinder. That is, each cylinder is provided with one intake valve (not shown) and one exhaust valve (not shown). In this embodiment, the intake valve and the exhaust valve of the each cylinder are driven by one cam shaft (not shown). The cam shaft is disposed at a substantially central portion of the cylinder head 3 along a cylinder row direction.

As shown in FIG. 1 and FIG. 2, the ignition plug mounting portion 10 is positioned nearer to the other side surface side of the internal combustion engine 1 than the exhaust port 6. As shown in FIG. 4, this ignition plug mounting portion 10 is formed to be inclined with respect to a cylinder central axis L so that a rear end of the mounted ignition plug 15 is positioned nearer to the other side surface side of the internal combustion engine 1 than the tip end of the ignition plug 15. That is, the entire of the ignition plug mounting wall 11 is formed to be inclined toward the other side surface side of the internal combustion engine 1 with respect to the cylinder central axis L. By the thus-constructed ignition plug mounting portion 10, it is possible to avoid interference with the cam shaft. Besides, the ignition plug mounting portion 10 is inclined with respect to the cylinder central axis L so that the rear end of the mounted ignition plug 15 is positioned nearer to the one end side of the cylinder row direction than the tip end of the ignition plug 15.

The cylinders 4 of the cylinder block 2 are formed, respectively, by cylindrical cylinder walls 16. An upper end of each cylinder wall 16 is continuous with a circumference edge portion of the top wall 12. A portion near the upper end of the cylinder wall 16 corresponds to a side portion of the combustion chamber 5. A skirt portion 17 constituting a crank case with an oil pan (not shown) is integrally formed with a lower portion of the cylinder block 2.

This internal combustion engine 1 includes a water jacket 21 which is formed by a core, and which extends in the cylinder row direction between the cylinder head 3 and the cylinder block 2. That is, water jacket outer walls 22 are formed outside the top walls 12 of the combustion chambers, upper half portions of the cylinder walls 16, tip end sides of the exhaust port walls 7, tip end sides of the intake port walls 9, and tip end sides of the ignition plug mounting walls 11, so as to surround these portions. That is, the water jacket 21 is formed to cover the combustion chambers 5, the upper end portions of the cylinders 4, the exhaust ports 6, the intake ports 8, and the ignition plug mounting portions 10.

The water jacket 21 through which the coolant passes is divided into a first water jacket portion 24 on the cylinder head side, and a second water jacket portion 25 on the cylinder block side, by a partition wall 23 which has a flat plate shape, and which extends in the cylinder row direction. Besides, the partition wall 23 is not limited to the flat plate shape as long as the partition wall 23 has the plate shape. The partition wall 23 may have a curved portion, and so on.

The partition wall 23 is connected to a connection portion between the top wall 12 of the combustion chamber 5 and the exhaust port wall 7, on the one side surface side of the internal combustion engine 1 (on the right side of FIG. 3), with respect to the combustion chamber 5. The partition wall 23 is connected to a portion of the upper end side of the cylinder wall 16 which constitutes a side wall of the combustion chamber 5, on the other side surface side of the internal combustion engine 1, with respect to the combustion chamber 5.

That is, as shown in FIG. 3 when viewed from the crank shaft axial direction, a portion of the partition wall 23 on the one side surface side of the internal combustion engine 1 (on the right side of FIG. 3) is positioned at an upper position than a portion of the partition wall 23 on the other side surface side of the internal combustion engine 1 (on the left side of FIG. 3). That is, the entire of the partition wall 23 is obliquely inclined so that the exhaust port side of the partition wall 23 is positioned nearer to the cylinder head than the intake port side of the partition wall 23.

As shown in FIG. 2, the water jacket 21 includes a coolant introduction inlet 28 which is poisoned on the one end side of the first water jacket portion 24 in the cylinder row direction, and which is positioned on the other side surface side of the internal combustion engine 1. A coolant discharge opening (not shown) is provided adjacent to the coolant introduction opening 28, below the coolant introduction opening 28. This coolant discharge opening is provided on the one end side of the second water jacket portion 25 in the cylinder row direction, on the other side surface side of the internal combustion engine 1. As shown in FIG. 2, the partition wall 23 includes a through hole 29 which is positioned on the other end side of the cylinder row direction, on the one side surface side of the internal combustion engine 1, and which connects the first water jacket portion 24 and the second water jacket portion 25. This through hole 29 is formed within the water jacket 21 at a position on a diagonal line with respect to the coolant introduction opening 28 and the coolant discharge opening.

The coolant introduced into the water jacket 21 flows within the first water jacket 24. Then, this coolant flows into the second water jacket portion 25. Accordingly, it is possible to cool the exhaust port 6 positioned within the first water jacket portion 24 by the low temperature coolant which has a small thermal influence from the combustion chamber 5.

In the internal combustion engine 1 according to this embodiment, the knock sensor mounting boss 26 is provided at a position on the extension line of the partition wall 23, on the other side surface side of the internal combustion engine 1, as shown in FIG. 3. The partition wall 23 is connected to the combustion chamber 5. Accordingly, the vibration of the knocking generated within the combustion chamber 5 is easy to be transmitted in the partition wall 23.

Therefore, by setting the knock sensor mounting boss 26 at the above-described position, it is possible to improve the detection accuracy of the knocking by the knocking sensor 27 mounted to the knocking sensor mounting boss 26, and to further stabilize the combustion within the combustion chamber 5. Moreover, it is possible to further suppress the abnormal pressure variation within the combustion chamber 5. Besides, it is optional to arbitrarily vary the position of the knocking sensor mounting boss 26 along the cylinder row direction.

In the internal combustion engine 1 according to this embodiment, the partition wall 23 is provided. With this, it is possible to decrease the thermal influence on the coolant around the exhaust port 6 from the combustion chamber 5, relative to the coolant around the intake port 8. Accordingly, it is possible to be easy to cool the exhaust port 6, and thereby to suppress the thermal deformation of the exhaust port 6.

The partition wall 23 is connected to the connection portion between the top wall 12 of the combustion chamber 5 and the exhaust port 6, on the one side surface side of the internal combustion engine 1, with respect to the combustion chamber 5. Accordingly, it is possible to cool the exhaust port 6 by the low temperature coolant before receiving the heat from the combustion chamber 5. Consequently, it is possible to further suppress the thermal deformation of the exhaust port 6.

Moreover, the entire of the combustion chamber 5 is supported by the partition wall 23. Accordingly, it is possible to improve the rigidity of the combustion chamber 5.

By the suppression of the thermal deformation of the exhaust port 6 and the improvement of the rigidity of the combustion chamber 5, it is possible to decrease the stress generated in the wall portion (the top wall 12 and the upper end portion of the cylinder wall 16) constituting the combustion chamber 5 due to the influence of the thermal deformation of the exhaust port 6. Accordingly, it is possible to suppress the deformation of the combustion chamber 5 and the deformation of the cylinder 4, and to suppress the increase of the friction of the internal combustion engine 1.

The ignition plug mounting wall 11 is formed to be inclined toward the other side surface side of the internal combustion engine 1 with respect to the cylinder central axis L. Accordingly, it is possible to set a relatively large angle formed by the partition wall 23 and the ignition plug mounting wall 11, on the other side surface side of the internal combustion engine 1, when viewed from the axial direction of the crank shaft. That is, the ignition plug mounting wall 11 is connected so as to be inclined toward the other side surface side of the internal combustion engine 1, with respect to the partition wall 23 inclined so that a portion on the one side surface side of the internal combustion engine 1 becomes a relatively high when viewed from the crank shaft direction. Accordingly, it is possible to set a relatively large angle which is between the ignition plug mounting wall 11 and the partition wall 23 on the one side surface side of the internal combustion engine 1 while ensuring the angle which is between the ignition plug mounting wall 11 and the partition wall 23 on the other side surface side of the internal combustion engine 1. Therefore, it is possible to efficiently cool the entire circumference of the tip end side of the ignition plug mounting portion 10 (the ignition plug mounting wall 11) by the water jacket 21.

Besides, as shown by an imaginary line (two dot chain line) in FIG. 2, there may be provided a second partition wall 31 which is provided in the internal combustion engine 1, which has a flat plate shape, which extends in the cylinder row direction, and which divides the water jacket 21 into the exhaust port side and the intake port side along the cylinder row direction.

In a case where this second partition wall 31 is provided, an exhaust port side water jacket constituted by a portion of the first water jacket portion 24 on the exhaust port side, a portion of the second water jacket portion 25 on the exhaust port side constitutes one independent cooling system. An intake port side water jacket constituted by a portion of the first water jacket portion 24 on the intake port side, and a portion of the second water jacket portion 25 on the intake port side constitutes one independent cooling system. That is, the water jacket 21 is constituted by the exhaust port side water jacket and the intake port side water jacket which are two cooling systems that are independent from each other. In a case where this second partition wall 31 is provided, two through holes each of which corresponds to one of the exhaust port side water jacket and the intake port side water jacket are formed, for example, in the partition wall 23 on the other end side of the cylinder row direction.

A flow of the coolant flowing into the water jacket 21 is controlled, for example, by a thermos valve in accordance with the coolant temperature. For example, the coolant flows only into the exhaust port side water jacket in a cold state. After the completion of the warming-up, the coolant flows into both the exhaust port side water jacket and the intake port side water jacket. With this, it is possible to improve the warming-up performance of the internal combustion engine 1.

The invention claimed is:

1. An internal combustion engine comprising:

a cylinder block in which at least one cylinder is formed;

a cylinder head including an intake port and an exhaust port, the cylinder head being integrally formed with the cylinder block;

a water jacket covering circumferences of the cylinder, the intake port, and the exhaust port;

a partition wall dividing the water jacket into a cylinder block side and a cylinder head side;

a combustion chamber formed by the cylinder, a piston arranged to be reciprocated within the cylinder, and the cylinder head, wherein the exhaust port is connected from one side surface side of the internal combustion engine to a top portion of the combustion chamber;

the intake port is connected from an other side surface side of the internal combustion engine to the top portion of the combustion chamber;

the partition wall is connected to a connection portion between the top portion of the combustion chamber and the exhaust port, on the one side surface side of the internal combustion engine, with respect to the combustion chamber; and the partition wall is connected to a side portion of the combustion chamber, on the other side surface side of the internal combustion engine, with respect to the combustion chamber; and a knock sensor mounting boss provided on a side surface of the other end surface side of the internal combustion engine, at a position on an extension line of the partition wall.

2. The internal combustion engine as claimed in claim 1, wherein the partition wall is inclined such that an exhaust port side of the partition wall is positioned nearer to the cylinder head side than an intake port side of the partition wall.

3. The internal combustion engine as claimed in claim 1, wherein the cylinder head includes ignition plug mounting portions according to a number of cylinders; and each of the ignition plug mounting portions is positioned nearer to the other side surface side of the internal combustion engine than the exhaust port.

4. The internal combustion engine as claimed in claim 3, wherein each of the ignition plug portions is inclined with respect to a cylinder central axis such that a rear end of a mounted ignition plug is positioned nearer to the other side surface side of the internal combustion engine than a tip end of the mounted ignition plug.

5. The internal combustion engine as claimed in claim 1, wherein the partition wall extends in a cylinder row direction;

the partition wall divides the water jacket into a first jacket portion on the cylinder head side, and a second water jacket portion on the cylinder block side;

the partition wall includes a through hole which is positioned on the other end side of the cylinder row direction, and which connects the first water jacket portion and the second water jacket portion; and the water jacket is arranged to introduce a coolant from a portion of the first water jacket portion on one end side of the cylinder row direction, and to discharge the coolant from a portion of the second water jacket portion on the one end side of the cylinder row direction.

6. The internal combustion engine as claimed in claim 1, wherein the internal combustion engine includes a second partition wall dividing the water jacket into an exhaust port side and an intake port side in a cylinder row direction;

the water jacket includes an exhaust port side water jacket which is positioned nearer to the one side surface side of the internal combustion engine than the second partition wall, and an intake port side water jacket which is positioned nearer to the other side surface side of the internal combustion engine than the second partition wall; and the water jacket is arranged to flow the coolant only into the exhaust port side water jacket in a cold state, and to flow the coolant into both of the exhaust port side water jacket and the intake port side water jacket after a completion of a warming-up.

7. The internal combustion engine as claimed in claim 1, wherein each of the cylinders comprises an intake valve and an exhaust valve which are driven by a cam shaft.

* * * * *